US008337240B2

(12) United States Patent
Feldmeier et al.

(10) Patent No.: US 8,337,240 B2
(45) Date of Patent: Dec. 25, 2012

(54) HIGH-CURRENT PLUG-IN CONNECTOR

(75) Inventors: Guenter Feldmeier, Lorsch (DE); Horst Braun, Gummersbach (DE); Zoltan Lampert, Troisdorf (DE); Thomas Schnurpfeil, Meckenheim (DE)

(73) Assignee: Tyco Electronics AMP GmbH, Bensheim (DE)

( * ) Notice: Subject to any disclaimer, the term of this patent is extended or adjusted under 35 U.S.C. 154(b) by 5 days.

(21) Appl. No.: 13/133,913

(22) PCT Filed: Dec. 2, 2009

(86) PCT No.: PCT/EP2009/066229

§ 371 (c)(1),
(2), (4) Date: Jun. 9, 2011

(87) PCT Pub. No.: WO2010/066618

PCT Pub. Date: Jun. 17, 2010

(65) Prior Publication Data

US 2011/0244714 A1 Oct. 6, 2011

(30) Foreign Application Priority Data

Dec. 12, 2008 (DE) ..... 10 2008 061 934

(51) Int. Cl.
*H01R 3/00* (2006.01)

(52) U.S. Cl. ..... 439/488; 439/681

(58) Field of Classification Search ..... 439/842, 439/843, 845, 847–852, 884, 488, 680, 681, 439/278–283, 181

See application file for complete search history.

(56) References Cited

U.S. PATENT DOCUMENTS

| | | | | |
|---|---|---|---|---|
| 3,143,384 | A * | 8/1964 | Senior, Jr. | 439/282 |
| 3,226,667 | A * | 12/1965 | Senior, Jr. | 439/282 |
| 3,396,360 | A * | 8/1968 | Piaget | 439/282 |
| 3,681,742 | A * | 8/1972 | Newman | 439/744 |
| 3,689,866 | A * | 9/1972 | Kelly | 439/586 |
| 3,715,708 | A * | 2/1973 | Lloyd et al. | 439/675 |

(Continued)

FOREIGN PATENT DOCUMENTS

EP 0693798 A1 1/1996

(Continued)

OTHER PUBLICATIONS

International Preliminary Report on Patentability, dated Jun. 14, 2011, issued by the International Bureau of WIPO, Geneva, Switzerland, for PCT/EP2009/066229; 5 pages.

(Continued)

*Primary Examiner* — Ross Gushi
(74) *Attorney, Agent, or Firm* — Faegre Baker Daniels LLP

(57) ABSTRACT

The present invention relates to high-current plug-in connectors, in particular to unipolar high-current plug-in connectors for wind turbine generator systems, which can be arranged beside one another in a space-saving manner and can also meet high requirements on the current-carrying capacity. According to the invention, this is achieved in that cross-sections of which the longitudinal extent exceeds the transverse extent are selected for the plug-in and coupling contact. This means that the dimension in the transverse direction can be restricted and simultaneously the cable cross-section and the contact surface required from an electrical point of view are provided by the increased longitudinal extent. Moreover, the plug and the coupling comprise a visible mechanical coding, which prevents accidental reversal of the polarity of adjacently arranged cables.

25 Claims, 8 Drawing Sheets

Figure 1:
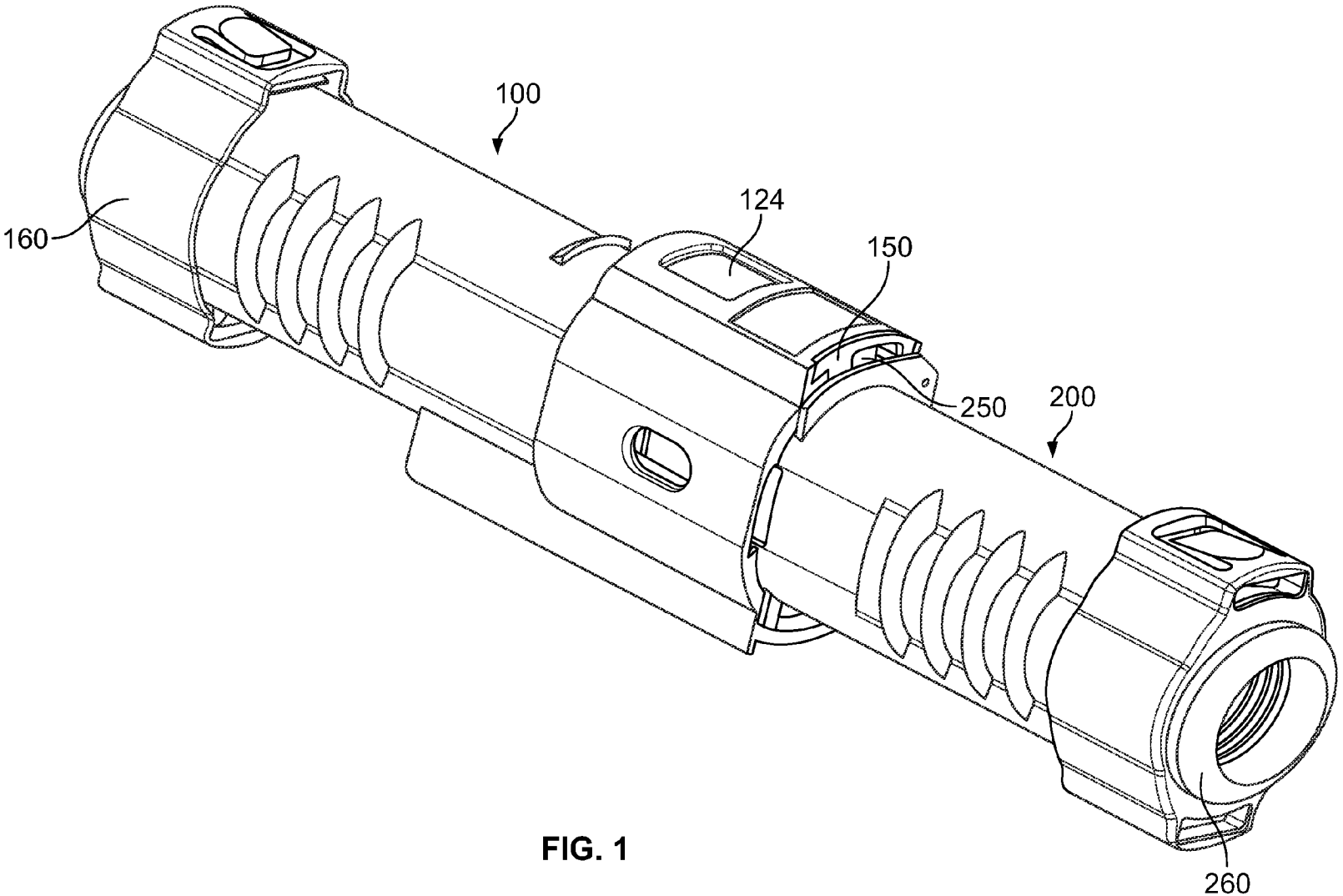

U.S. PATENT DOCUMENTS 3,994,553 A * 11/1976 Kornick ..... 439/281
4,111,511 A * 9/1978 Bolin ..... 439/252
4,605,272 A * 8/1986 Myers et al. ..... 439/281
4,702,539 A * 10/1987 Cusick et al. ..... 439/588
4,973,266 A * 11/1990 Bullard ..... 439/589
4,986,764 A * 1/1991 Eaby et al. ..... 439/275
5,083,944 A * 1/1992 Self, Jr. ..... 439/595
5,304,073 A * 4/1994 Golobay et al. ..... 439/282
5,545,842 A * 8/1996 Balsells ..... 174/372
5,824,962 A * 10/1998 Katsuma ..... 174/135
5,911,605 A * 6/1999 Wooldridge et al. ..... 439/790
6,039,614 A * 3/2000 Ramari ..... 439/843
6,071,145 A * 6/2000 Toly ..... 439/485
6,077,131 A * 6/2000 Fukuda et al. ..... 439/884
6,276,960 B1 * 8/2001 Schaefer et al. ..... 439/522
6,416,340 B2 * 7/2002 Schaefer et al. ..... 439/224
6,520,998 B1 * 2/2003 Scholler et al. ..... 439/851
6,666,734 B2 * 12/2003 Fukatsu ..... 439/884
6,692,316 B2 * 2/2004 Hsieh et al. ..... 439/845
6,790,106 B2 * 9/2004 Ito et al. ..... 439/884
6,895,276 B2 * 5/2005 Kast et al. ..... 607/37
7,077,681 B2 * 7/2006 Behoo ..... 439/333
7,081,016 B2 * 7/2006 Tateno ..... 439/585
7,150,660 B2 * 12/2006 Allgood et al. ..... 439/845
7,195,510 B2 * 3/2007 Wakefield et al. ..... 439/354
7,195,514 B2 * 3/2007 Wakefield et al. ..... 439/465
7,195,524 B1 * 3/2007 Lin et al. ..... 439/851
7,241,189 B2 * 7/2007 Mohs et al. ..... 439/845
7,314,377 B2 * 1/2008 Northey et al. ..... 439/79
7,377,825 B2 * 5/2008 Bankstahl ..... 439/889
7,387,537 B1 6/2008 Daily et al.
7,462,080 B2 * 12/2008 Shiraishi et al. ..... 439/852
7,601,019 B2 * 10/2009 Hsieh et al. ..... 439/345
7,658,657 B1 * 2/2010 Scanzillo et al. ..... 439/825
7,677,935 B2 * 3/2010 Ogata et al. ..... 439/845
7,682,208 B2 * 3/2010 Bankstahl ..... 439/889
7,695,333 B2 * 4/2010 Strickland, Jr. ..... 439/889
7,775,840 B2 * 8/2010 Matsumoto et al. ..... 439/843
7,789,720 B2 * 9/2010 Zinn ..... 439/845
7,892,047 B2 * 2/2011 Strickland, Jr. ..... 439/738
7,909,658 B2 * 3/2011 Pfaffenbach ..... 439/680
8,038,488 B2 * 10/2011 Mukuno ..... 439/845
8,128,441 B2 * 3/2012 Mukuno ..... 439/845
8,157,594 B2 * 4/2012 Gilliam ..... 439/607.41
8,226,428 B2 * 7/2012 Arnaud et al. ..... 439/252
2003/0060090 A1 * 3/2003 Allgood et al. ..... 439/845
2003/0194919 A1 * 10/2003 Hsieh et al. ..... 439/845
2004/0166744 A1 * 8/2004 Inaba et al. ..... 439/843
2006/0063396 A1 * 3/2006 Bankstahl ..... 439/11
2006/0063412 A1 * 3/2006 Matsumoto et al. ..... 439/274
2006/0084325 A1 * 4/2006 Wakefield et al. ..... 439/736
2006/0199411 A1 * 9/2006 Singh et al. ..... 439/314
2007/0049125 A1 * 3/2007 Haller ..... 439/676
2007/0066152 A1 * 3/2007 Mohs et al. ..... 439/843
2008/0032542 A1 * 2/2008 Bankstahl ..... 439/363
2008/0146064 A1 * 6/2008 Bankstahl ..... 439/332
2009/0130922 A1 * 5/2009 Arnaud et al. ..... 439/825
2009/0156057 A1 * 6/2009 Strickland, Jr. ..... 439/582
2009/0275246 A1 * 11/2009 Strickland, Jr. ..... 439/738
2010/0003866 A1 * 1/2010 Dent et al. ..... 439/843
2010/0015834 A1 * 1/2010 Siebens ..... 439/299
2010/0136808 A1 * 6/2010 Vanzo ..... 439/118
2011/0074153 A1 * 3/2011 Feldmeier et al. ..... 290/44
2011/0244714 A1 * 10/2011 Feldmeier et al. ..... 439/488
2012/0003884 A1 * 1/2012 Lampert et al. ..... 439/884

FOREIGN PATENT DOCUMENTS

WO WO 2008/031526 A1 3/2008

OTHER PUBLICATIONS

International Search Report and Written Opinion issued by the European Patent Office, dated Apr. 23, 2010, for PCT/EP2009/066229; 12 pages.

* cited by examiner

HIGH-CURRENT PLUG-IN CONNECTOR

The present invention relates to high-current plug-in connectors, in particular to unipolar high-current plug-in connectors for wind turbine generator systems.

In wind turbine generator systems with a horizontal rotor axis, the generator is conventionally disposed in the direct vicinity of the rotor in the pod at the pinnacle of the tower. The power cables which connect the generator to the network supply at the foot of the tower are laid on the internal wall of the tower. To simplify the assembly of the wind turbine generator system as a whole, the tower is assembled from individual preassembled segments. Each of these segments in particular already contains a corresponding portion of the cabling. In the course of the assembly of the tower, the cable portions of the individual segments are interconnected. In this way, the difficulties involved in providing the cabling subsequently can be avoided.

The U.S. document U.S. 2006/0199411 discloses an improved cable system for a wind turbine generator system, in which the cable portions of each tower segment are provided at both ends with plug-in connectors, by means of which the individual cable portions are interconnected during the assembly of the tower. This simplifies the assembly and also the maintenance of the cabling.

The plug-in connectors used for connecting the power cable portions must be adapted to the increased electrical and mechanical requirements. Typical power values for modern wind turbine generator systems are in the region of 1 kV at 1 kA, and cable cross-sections are in the region of 400 $mm^2$ for aluminium cables and 300 $mm^2$ for copper cables.

The plug-in connector disclosed in the above-mentioned US document consists of a substantially cylindrical plug-in contact and a correspondingly formed coupling, which are each axially connected to the cable via integrally moulded crimping sleeves. To take up the tension acting on the plug-in connection, a radial pin is provided on the interior of the coupling contact sleeve and a corresponding annular undercut is provided on the plug-in contact, and these engage in one another in the form of a bayonet coupling. To prevent an undesired release of the plug-in connection, the bayonet coupling is additionally provided with a ratchet mechanism.

In the wind turbine generator systems described above, the power cabling is conventionally implemented in the form of a loom of a plurality of cables which are arranged directly beside one another and which are fixed to the inside of the tower. In this case, however, the conventional plug-in connectors cannot be used because there is not enough space available for the high-volume plugs and couplings to be beside one another. However, it is also not possible to reduce the radial dimensions because a sufficient contact surface and cable cross-section for the high currents must be provided.

A further drawback of the conventional plug-in connector is the risk of incorrect cabling due to mixing up the plugs and couplings respectively associated with the three phases.

The German Offenlegungsschrift DE 44 20 984 A1 discloses a multi-polar, codable plug-in connector, in which the plug part and the socket part comprise profile grooves which are respectively associated with the individual poles and which come into sliding contact with one another when the plug-in connector is plugged together. Coding elements can be inserted into the profile grooves, and each engage in the adjacent profile groove with a web projecting from the profile groove. Within the cross-section of the coding elements, the webs each take up only half of the width of the profile grooves. The coding elements can be inserted into the profile grooves in two positions rotationally offset by 180°, in such a way that upon insertion, the webs thereof either slide past one another or strike and block one another. By inserting the coding elements correctly, 2" different codings can be implemented for an n-polar plug-in connector.

However, it is virtually impossible for the user of plug-in connectors of this type to know in advance whether or not a particular plug fits in a particular socket. This leaves only trial and error for plugging them together, and this is made even more difficult because it is impossible for the user to tell whether the fact that the plug and socket cannot readily be plugged together is due to a different coding or to other mechanical difficulties. Moreover, the use of multi-polar plug-in connectors to connect the power cables of a wind turbine generator system is unfeasible in view of the cable cross-section and the required contact forces.

The object of the present invention is therefore to provide an improved high-current plug-in connector for use in wind turbine generator systems.

This is achieved by the features of the independent claim. Preferred embodiments are the subject-matter of the dependent claims.

The specific approach of the present invention is to configure the plug-in contact and the coupling contact of a plug-in connection in such a way that the longitudinal extent of the plug or coupling cross-section exceeds the transverse extent. This allows both the geometric requirements, as regards the space-saving arrangement of a plurality of plug-in connectors beside one another, and the electrical requirements, as regards the necessary cable cross-section and the contact surfaces, to be met simultaneously.

According to the present invention, a unipolar high-current plug-in connector for a wind turbine generator system is provided. The high-current plug-in connector comprises a plug-in contact in a plug housing and a coupling contact in a coupling housing and is characterised in that the plug-in contact and the coupling contact have a cross-section of which the longitudinal extent exceeds the transverse extent.

In particular, the plug-in contact and the coupling contact may have an oval cross-section, a substantially rectangular, non-square cross section, or a substantially rectangular, non-square cross-section with rounded or slanted corners.

Preferably, the coupling contact is substantially in the form of a hollow cylinder and the plug-in contact is substantially in the form of a cylinder, it being possible to introduce the plug-in contact into the coupling contact in an insertion direction parallel to the cylinder axis of the plug-in contact and parallel to the cylinder axis of the coupling contact.

It is advantageous for the high-current plug-in connector to comprise at least one annular spring element, which is arranged transverse to the insertion direction in the coupling contact and which can enclose the plug-in contact in the coupling contact and thus be held clamped. Preferably, the spring element is a flat coil spring wound in a torus shape. The contact force exerted by the spring element provides reliable electrical contact between the plug-in contact and the coupling contact and a low transition resistance.

Preferably, projections for fixing the spring element are provided on the inside of the coupling contact to prevent the spring element from being displaced in the coupling contact when the plug-in connection is plugged together or separated.

It is advantageous for the plug-in contact and the coupling contact to be formed as a stamped and bent part, allowing cost-effective, high-volume serial manufacture of the plug-in connector to be achieved.

It is advantageous for the coupling contact to be latched in the coupling housing by a latch hook attached to the coupling housing and for the latch hook to be locked by the plug-in contact or the plug housing when the plug is connected to the coupling. In the same way, the plug-in contact can be latched in the plug housing by a latch hook attached to the plug housing and the latch hook can be locked by the coupling contact or the coupling housing when the plug is connected to the coupling. This ensures a fixed placement of the coupling and plug-in contact in the respective housing.

It is advantageous for the high-current plug-in connector to comprise an externally visible coding to prevent accidental reversal of the polarity of different cables.

According to a preferred embodiment, the plug housing is provided with a profile groove for receiving one of a plurality of different plug coding elements and the coupling housing is provided with a profile groove, lying opposite the profile groove in the plug housing, for receiving one of a plurality of different coupling coding elements, each of the different plug coding elements cooperating with exactly one of the different coupling coding elements and thus enabling mechanical coding of the plug-in connection. This makes it possible to rule out accidental reversal of the polarity of adjacently arranged cables.

Preferably, the plug coding elements comprise a web which extends parallel to the insertion direction and which engages in a corresponding groove in the associated coupling coding element, the web and the groove being arranged in different positions in each case for the different plug and coupling coding elements. Alternatively, the coupling coding elements may also comprise a web which extends parallel to the insertion direction and which engages in a corresponding groove in the associated plug coding element, the web and the groove being arranged in different positions in each case for the different plug and coupling coding elements. In both cases, a reliable mechanical coding can be obtained in a simple manner.

According to a particularly preferred embodiment, the different plug coding elements and the different coupling coding elements comprise a colour coding corresponding to the mechanical coding. Additionally, the plug housing or the coupling housing may comprise a viewing window which is arranged in the region of the profile groove and through which the colour coding of the plug or coupling coding element can be discerned. This means that the assembler can easily discern the mechanical coding and accordingly makes it easier to connect a plurality of different cables correctly.

In a further preferred embodiment, the coupling contact is latched in the coupling housing by a latch hook attached to the coupling housing and the latch hook is locked by the coupling coding element after the coupling coding element has been received in the profile groove. Conversely, the plug-in contact may also be latched in the plug housing by a latch hook attached to the plug housing and the latch hook may be locked by the plug coding element after the plug coding element has been received in the profile groove. This ensures a fixed placement of the contacts in the housings and the coding element also locks the contact.

Figure 2:
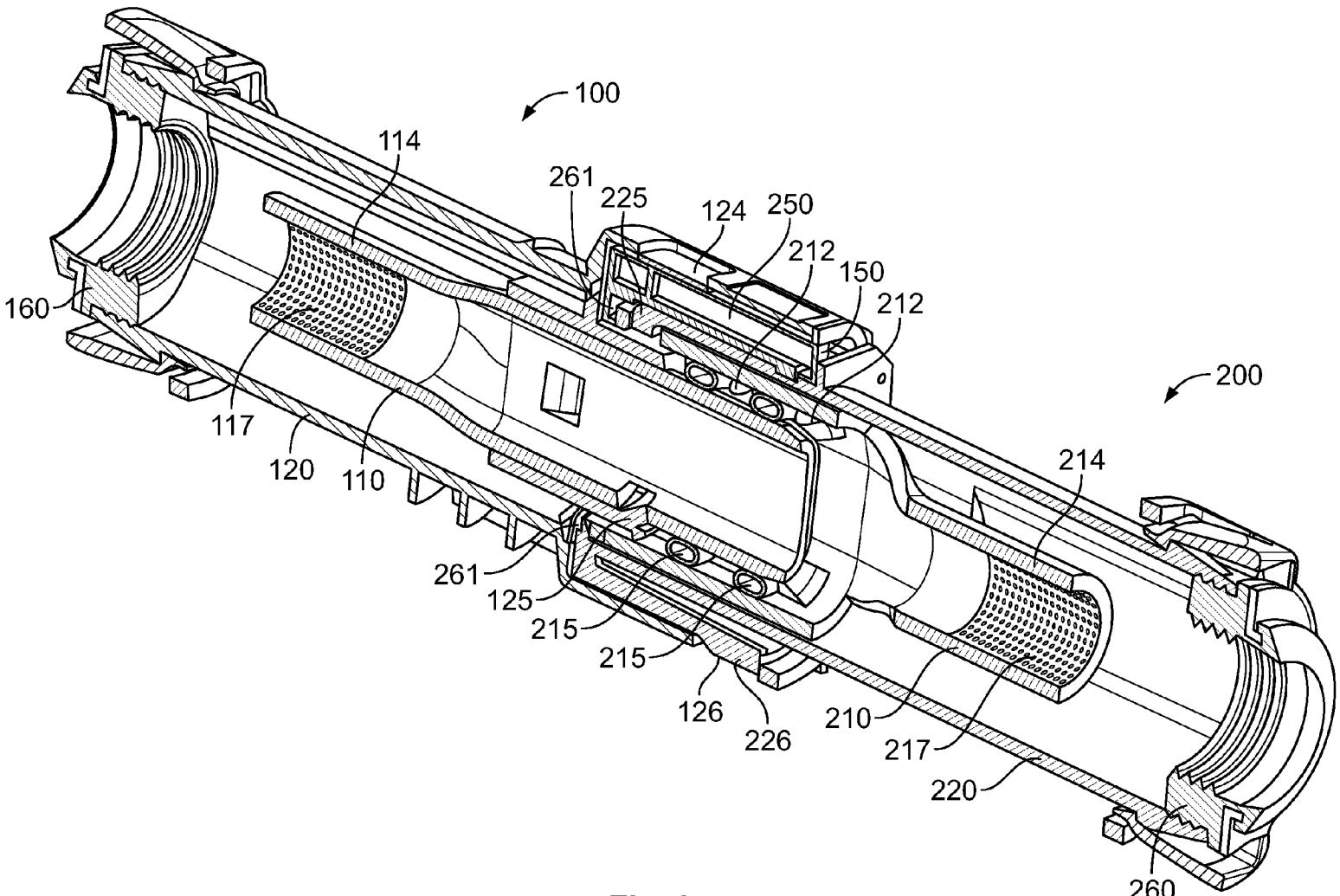
Figure 3:
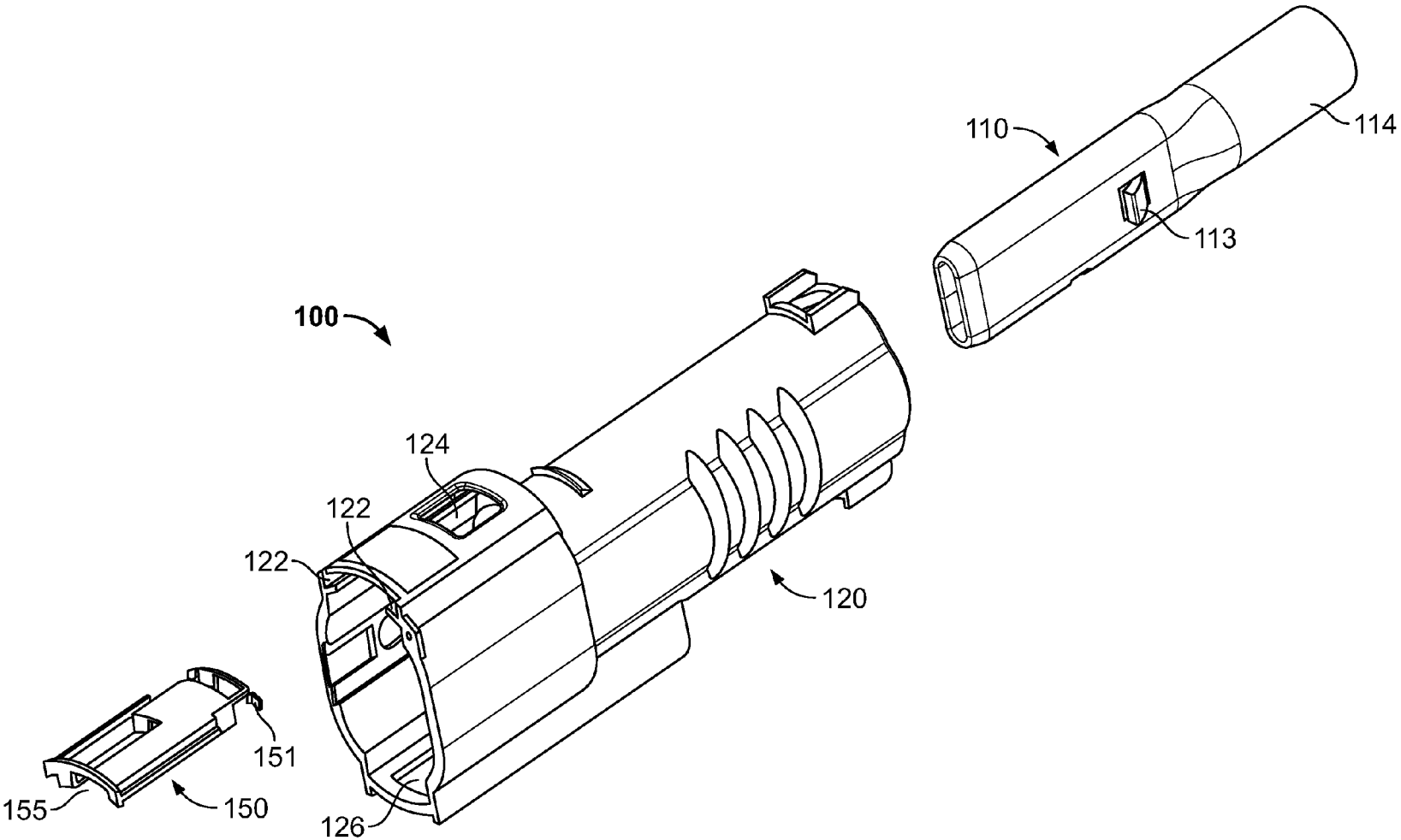
Figure 4:
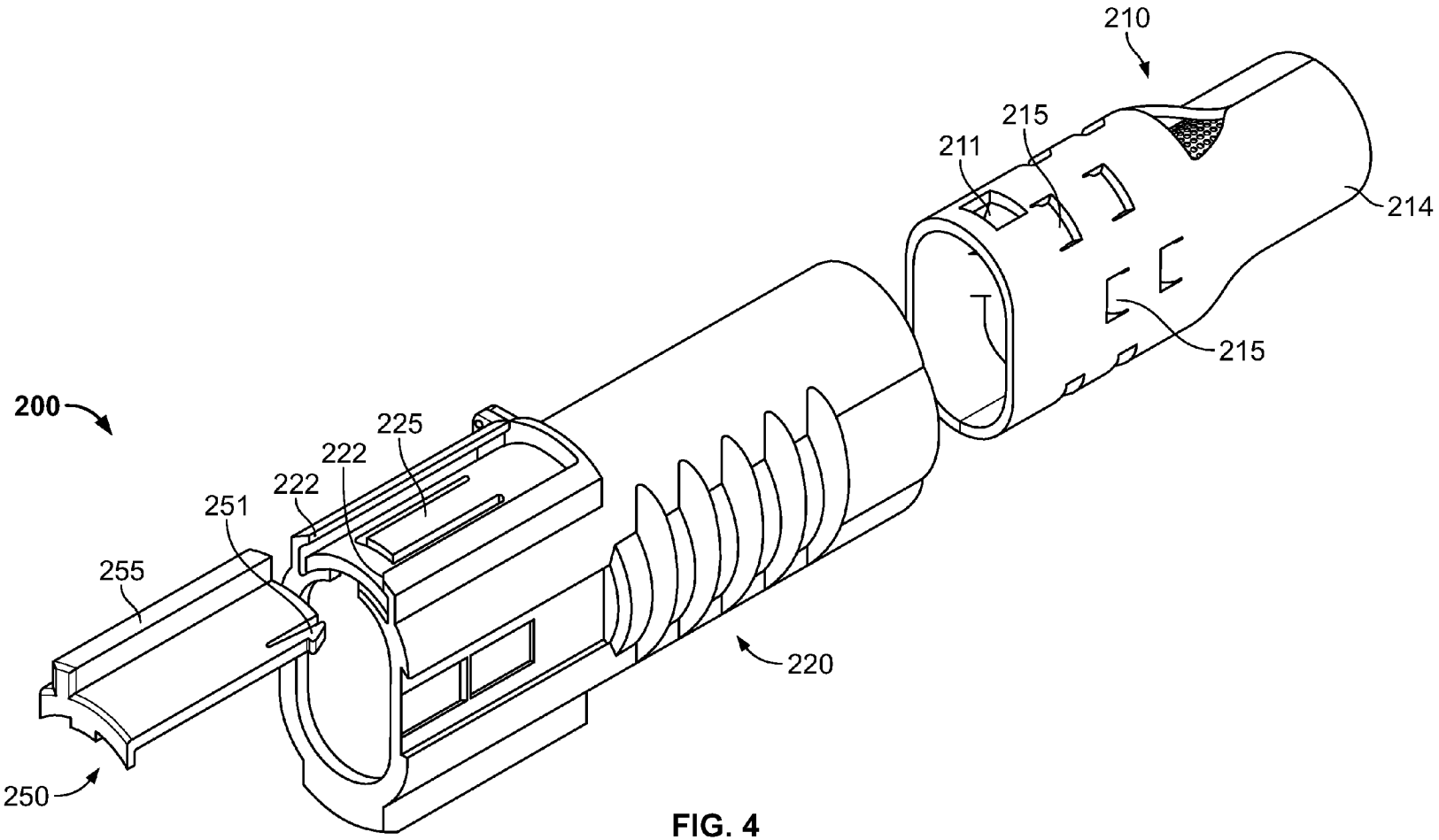
Figure 5A:
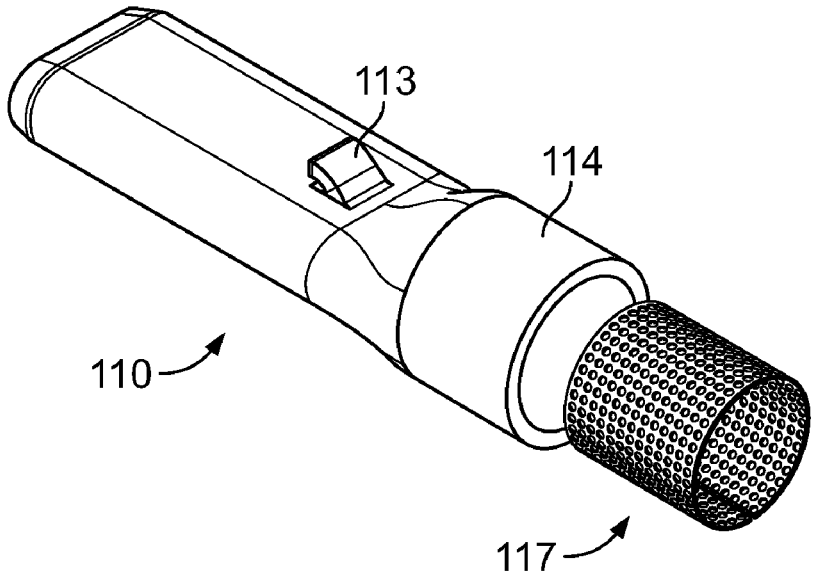
Figure 5B:
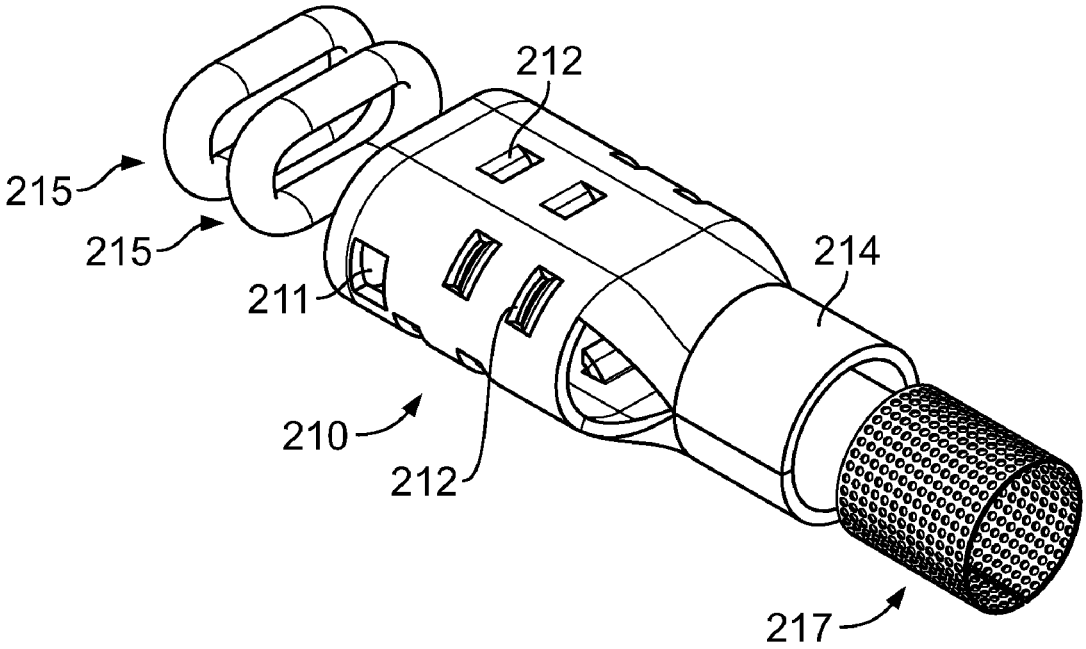
Figure 6A:
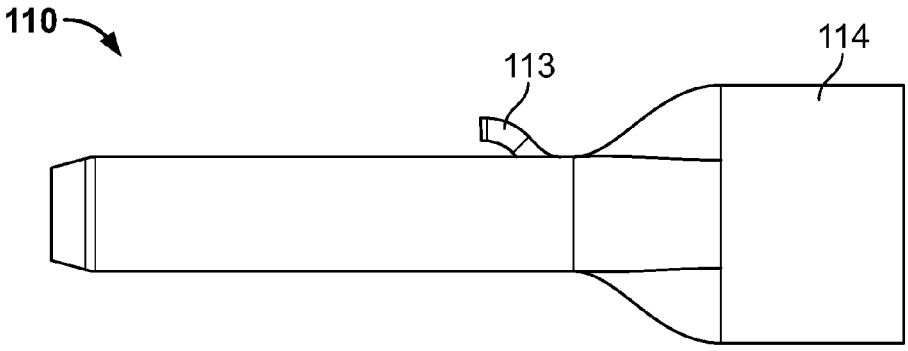
Figure 6B:
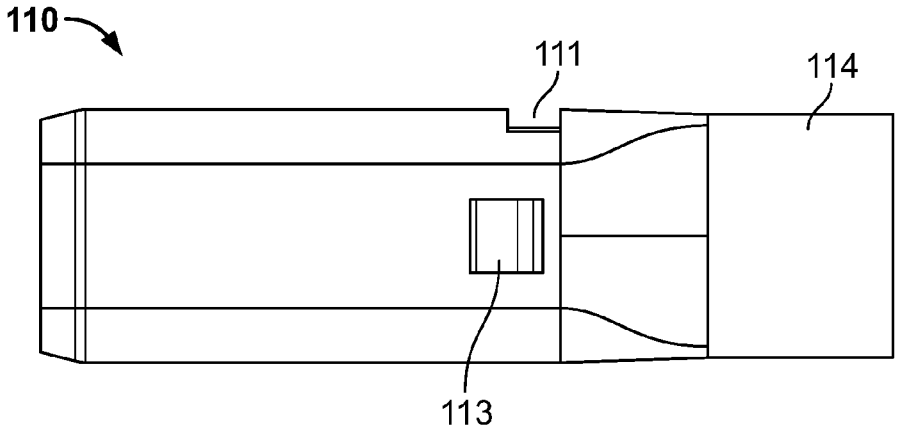
Figure 6C:
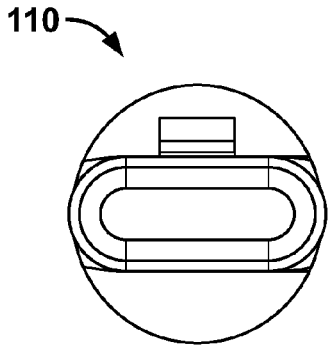
Figure 7A:
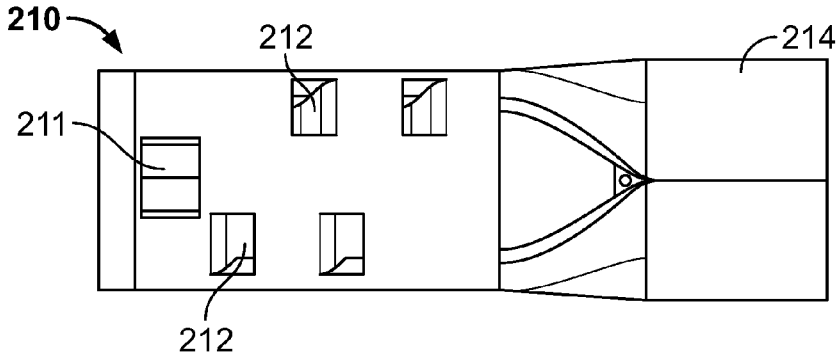
Figure 7B:
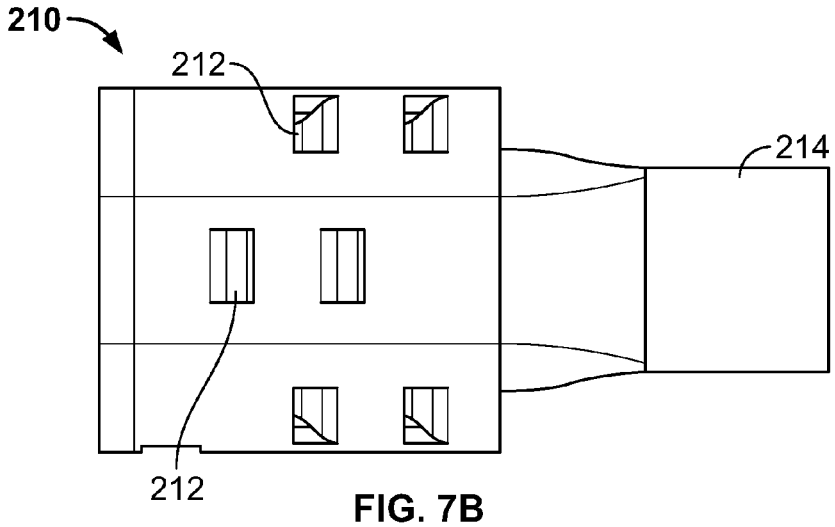
Figure 7C:
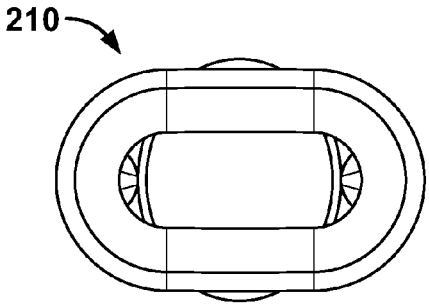
Figure 8A:
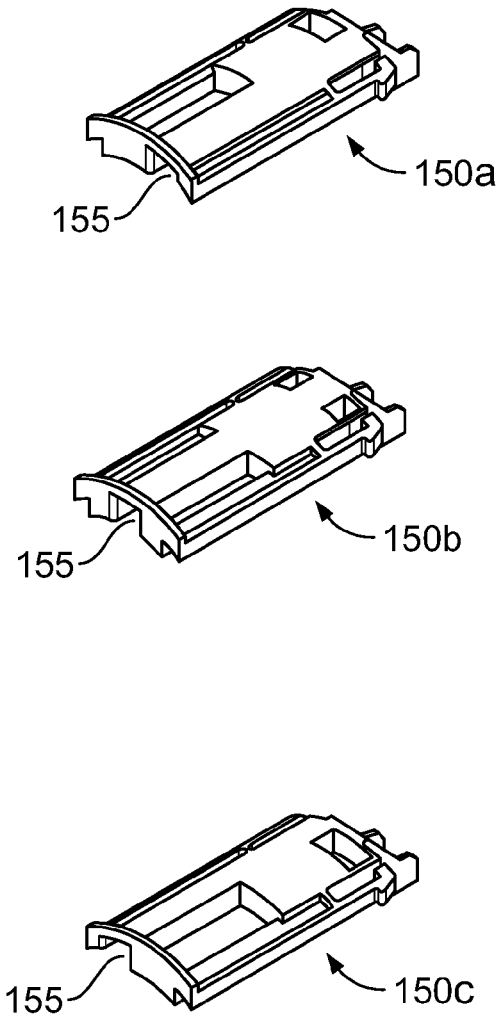
Figure 8B:
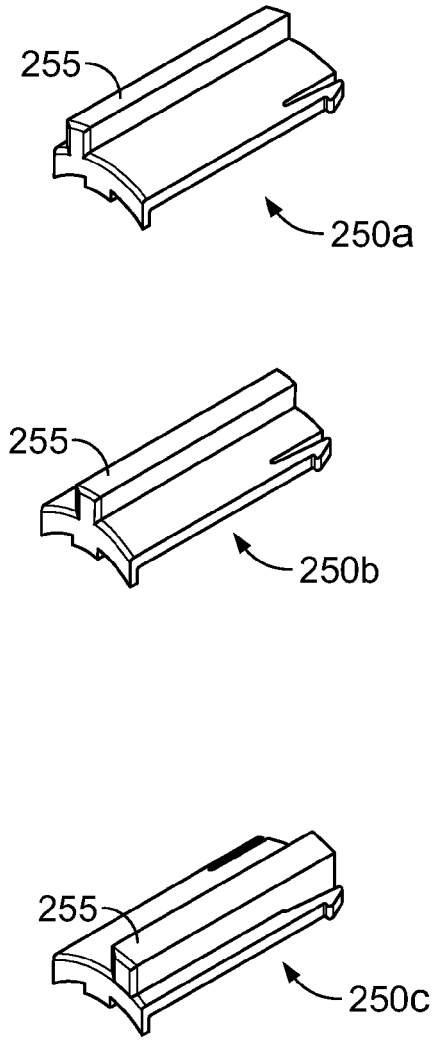

The invention is described in the following with reference to the appended drawings, in which:

FIG. 1 is a perspective view of the plug-in connector according to the invention, FIG. 2 is a perspective sectional drawing of the plug-in connector according to the invention, FIG. 3 is an exploded drawing of the plug of the plug-in connector according to the invention, FIG. 4 is an exploded drawing of the coupling of the plug-in connector according to the invention, FIG. 5A is an exploded drawing of the plug-in contact of the plug-in connector according to the invention, FIG. 5B is an exploded drawing of the coupling contact of the plug-in connector according to the invention, FIG. 6A is a side view of the plug-in contact of the plug-in connector according to the invention, FIG. 6B is a plan view of the plug-in contact of the plug-in connector according to the invention, FIG. 6C is a front view of the plug-in contact of the plug-in connector according to the invention, FIG. 7A is a side view of the coupling contact of the plug-in connector according to the invention, FIG. 7B is a plan view of the coupling contact of the plug-in connector according to the invention, FIG. 7C is a front view of the coupling contact of the plug-in connector according to the invention, FIG. 8A is a perspective view of the different plug coding elements, and FIG. 8B is a perspective view of the different coupling coding elements.

FIG. 1 is a perspective view of the plug-in connector according to the invention, which is also shown in cross-section in FIG. 2. The plug-in connector comprises a plug 100 and a coupling 200. In FIG. 1, cable seals 160, 260 can also be seen at the cable inputs, and these encompass the cables (not shown) and prevent the penetration of water or other fluids into the plug or the coupling. Moreover, a further sealing system 261 is provided for the plug face and seals the connection between the plug and the coupling.

Coding elements 150, 250 are also shown and mechanically prevent accidental insertion of the wrong plug into the wrong socket. Moreover, a viewing window 124 can be seen, and this additionally provides a colour coding of associated plugs and sockets.

The plug-in connector is provided with a locking mechanism which produces an audible click when the plug and the coupling are fully plugged together. The locking mechanism is formed by a locking lance 226 on the coupling housing 220 and an associated latch opening 126 in the plug housing 120. To release the plug-in connection, the locking lance 226 is pressed down through the latch opening 126. This prevents an undesired release of the plug-in connection.

A latch hook 125, to which the plug-in contact 110 is latched in the plug housing 120, is provided in the plug housing 120. Similarly, the coupling contact 210 is also latched to the coupling housing 220 via a latch hook 225. As can be seen in particular in FIG. 2, the latch hook 125 is locked by the coupling contact 210, in such a way that a fixed placement of the plug-in contact in the plug housing is provided. The latch hook 225 of the coupling housing is in turn locked by the coding element 250, as described further below.

In the coupling contact, annular spring elements 215 are provided transverse to the insertion direction and are braced between the plug-in contact and the coupling contact when the plug-in contact is plugged in and form the actual electrical connection. The spring elements are preferably formed by flat coil springs which are wound in a torus shape. Projections 212 are also provided in the coupling contact in order to keep the spring elements in place.

Both the plug-in contact and the coupling contact are provided with a crimp connection (114, 214). To establish the electrical connection with the cable, the bare cable is introduced into the sleeve-shaped crimp connection and pressed into it. To provide a reliable electrical contact even with aluminium cables, a perforated pressed screen (117, 217) may also be provided, and breaks up the oxide layers on the surface of the aluminium cable during the pressing process and thus ensures a lower transition resistance.

The plug and coupling housings and the coding elements are made of a non-conductive material, preferably from plastics material. Injection moulding is possible for high-volume production.

Preferably, the plug-in and coupling contacts consist of tin-plated copper, the spring elements consist of silver-plated beryllium copper and the perforated pressed screen consist of tin-plated brass. The plug-in and coupling contacts and the perforated pressed screen may advantageously be manufactured as a stamped and bent part.

FIG. 3 is an exploded drawing of the plug of the plug-in connector according to the invention, comprising the plug-in contact 110, the plug housing 120 and the plug coding element 150.

The plug-in contact comprises an oval cross-section at least in the insertion region. The insertion region is delimited on the connection side by a stop 113, which comes into contact with the coupling upon complete insertion. The plug-in contact further comprises a connection sleeve 114, the cross-section of which is fitted to the cross-section of the cable to be attached. Typically, the connection sleeve has a circular cross-section with an inner diameter of 27.7 mm for a cable cross section of 600 $mm^2$.

The plug-in contact is introduced into the plug housing from the cable side and latched thereto.

The plug housing comprises profile grooves 122 which are provided to receive a plug coding element 150. The plug coding elements have laterally arranged latch tabs 151, with which the coding element coming from the plug side is latched in the plug housing.

The plug coding elements further comprise a groove 155 extending in the insertion direction and provided to receive the web of the corresponding coupling coding element. The position of the groove is different in the different plug coding elements, in such a way as to allow mechanical coding of the plug.

In order to allow colour coding of the plug alongside the mechanical coding, the different plug coding elements may additionally be provided in different colours. The colour of the coding element used in the plug housing can be discerned by the user through the viewing window 124 in the plug housing.

FIG. 4 shows an exploded drawing of the coupling of the plug-in connector according to the invention, comprising the coupling contact 210, the coupling housing 220 and the coupling coding element 250.

The coupling contact 210 comprises, at least in the insertion region, an oval cross-section which is fitted to the cross-section of the plug-in contact 110 and the dimensions of the spring element 215. The coupling contact, similar to the plug-in contact, comprises a connection sleeve 214 of which the cross-section is fitted to the cross-section of the cable to be attached.

The coupling contact is introduced into the coupling housing from the cable side and latched thereto via the latch hook 225 and the latch opening 211.

The coupling housing likewise comprises profile grooves 222 which are provided to receive a coupling coding element 250. The coupling coding elements have laterally arranged latch tabs 251, with which the coding element coming from the plug side is latched in the coupling housing.

The coupling coding elements comprise a web 255 which extends in the insertion direction and is received by the groove of the corresponding plug coding element. The position of the web is different in the different coupling coding elements, in such a way as to allow mechanical coding of the coupling.

In order to allow colour coding of the coupling alongside the mechanical coding, the different coupling coding elements may be provided in different colours, analogously to the different plug coding elements.

Alongside the mechanical/colour coding of the coupling, the coding element 250 additionally locks the latching of the coupling contact 210 in the coupling housing 220. To latch the coupling contact in the coupling housing, the latch hook 225 must be deflected upwards upon insertion of the coupling contact until said hook latches into the latch opening 211. Conversely, the latch hook must be raised to remove the coupling contact from the coupling housing, in order to release the coupling contact. However, the latch hook is deprived of this freedom of movement by the coding element inserted into the profile grooves, in such a way that the coupling contact is locked in the coupling housing.

FIG. 5A shows an exploded drawing of the plug-in contact of the plug-in connector according to the invention, with the inserted perforated pressed screen 117. FIG. 5B shows an exploded drawing of the coupling contact of the plug-in connector according to the invention, with the inserted perforated pressed screen 217 and the spring elements 215.

FIG. 6A to 6C are side views, a plan view and a front view of the plug-in contact of the plug-in connector according to the invention. The oval cross-section of the plug-in contact in the insertion region is clearly discernible. Typical values for the long and short axes of the oval external cross-section are 35 mm and 15 mm respectively. The length of the insertion region from the peak of the plug-in contact to the stop 113 is approximately 58 mm. The total length of the plug-in contact may be 115 mm.

FIG. 7A to 7C are side views, a plan view and a front view of the coupling contact of the plug-in connector according to the invention. In this case, too, the oval cross-section of the coupling contact in the insertion region is clearly discernible. Typical values for the long and short axes of the oval external cross-section are approximately 50 mm and 30 mm respectively, the height and width of the coupling of the plug-in connector according to the invention being substantially fixed. The total length of the coupling contact may be 100 mm. The width of the coupling contact thus corresponds substantially to the cable diameter, whereas the height of the coupling contact considerably exceeds the cable diameter in order to make the necessary contact surface and the necessary cable cross-section available. The narrow configuration of the coupling means that a plurality of plug-in connectors of this type can be assembled directly beside one another without the total width of the resultant arrangement unnecessarily exceeding the width of the loom of cables.

Naturally, the present invention is not restricted to the stated dimensions of the plug-in contact, the coupling contact and the other components, which were purely illustrative, but can be implemented with any scaled dimensions and altered ratios as desired. All that matters is that the width of the plug-in connection should not substantially exceed the cable diameter, in order to allow a space-saving arrangement of a plurality of plug-in connectors beside one another, and that the height of the plug-in connector may by contrast substantially exceed the cable diameter throughout, in order to ensure the necessary contact surface and the required cable cross-section in accordance with the electrical requirements.

FIGS. 8A and 8B are a perspective view of the different plug coding elements 150*a*-150*c* and coupling coding elements 250*a*-250*c*. As was mentioned previously, the plug coding elements comprise a groove which is arranged in different positions, extends in the insertion direction, and can receive a correspondingly placed web of the associated coupling coding element. In the present case, three different codings are provided, corresponding to the three different phases of the power cable. These codings are implemented as grooves or webs arranged centrally or to the left or right of the centre. Of course, more or fewer possible codings may thus be provided. Moreover, the arrangement of the grooves in the plug-in coding elements and of the webs on the coupling coding elements can be exchanged, and so the plugs can be coded by coding elements with webs and the couplings can likewise be coded by coding elements with grooves.

In the above description, the term "oval" is used in connection with the cross-section of the plug-in or coupling contact. Despite a slightly different mathematical definition of this term, it is intended only to express that the longitudinal extent of the cross-section exceeds the transverse extent, and thus specifically that the cross-section is not circular. The precise shape of a cross-section of this type is naturally irrelevant to the present invention. Embodiments of the present invention may thus also have a non-square rectangular cross-section with or without rounded or slanted corners or a non-circular elliptical cross-section.

The degree to which the longitudinal extent of the cross-section exceeds the transverse extent will depend on the electrical requirements on the plug-in connection. However, according to the invention, the longitudinal extent of the cross-section exceeds the transverse extent substantially, i.e. by an amount which substantially exceeds the production tolerances, preferably by a factor greater than ten. Thus, the plug and the coupling can only be plugged together at the correct axial angular alignment and can no longer be rotated relative to one another in the inserted state. However, the longitudinal extent of the cross-section of the plug-in and coupling contact is in any case at least 10% greater than the corresponding transverse extent. Preferably, the transverse extent of the inner cross-section of the coupling contact is 50 to 75%, at most preferably 60% of the longitudinal extent. Depending on the strength of the spring elements used, the transverse extent of the external cross-section of the plug-in contact is 30 to 50%, at most preferably 40% of the longitudinal extent.

The present invention relates to high-current plug-in connectors, in particular to unipolar high-current plug-in connectors for wind turbine generator systems, which can be arranged beside one another in a space-saving manner and can also meet high requirements on the current-carrying capacity. According to the invention, this is achieved in that cross-sections of which the longitudinal extent exceeds the transverse extent are selected for the plug-in and coupling contact. This means that the dimension in the transverse direction can be restricted and simultaneously the cable cross-section and the contact surface required from an electrical point of view provided by the increased longitudinal extent. Moreover, the plug and the coupling comprise a visible mechanical coding, which prevents accidental reversal of the polarity of adjacently arranged cables.

The invention claimed is:

1. Unipolar high-current plug-in connector for a wind turbine generator system, comprising a plug-in contact in a plug housing and a coupling contact in a coupling housing, wherein the plug-in contact and the coupling contact have a cross-section of which the longitudinal extent exceeds the transverse extent, wherein the coupling contact is substantially in the form of a hollow cylinder and the plug-in contact is substantially in the form of a cylinder, it being possible to introduce the plug-in contact into the coupling contact in an insertion direction parallel to the cylinder axis of the plug-in contact and parallel to the cylinder axis of the coupling contact.

2. Unipolar high-current plug-in connector according to claim 1, wherein the plug-in contact and the coupling contact have an oval cross-section.

3. Unipolar high-current plug-in connector according to claim 1, wherein the plug-in contact and the coupling contact have a substantially rectangular, non-square cross section.

4. Unipolar high-current plug-in connector according to claim 1, wherein the plug-in contact and the coupling contact have a substantially rectangular, non-square cross-section with rounded or slanted corners.

5. Unipolar high-current plug-in connector according to claim 1, wherein at least one annular spring element, which is arranged transverse to the insertion direction in the coupling contact and which can enclose the plug-in contact in the coupling contact and thus be held clamped.

6. Unipolar high-current plug-in connector according to claim 5, wherein the spring element is a flat coil spring wound in a torus shape.

7. Unipolar high-current plug-in connector according to claim 5, wherein projections for fixing the spring element are provided on the inside of the coupling contact.

8. Unipolar high-current plug-in connector according to claim 1, wherein the plug-in contact and the coupling contact are formed as a stamped and bent part.

9. Unipolar high-current plug-in connector for a wind turbine generator system, comprising a plug-in contact in a plug housing and a coupling contact in a coupling housing, wherein the plug-in contact and the coupling contact have a cross-section of which the longitudinal extent exceeds the transverse extent, wherein the coupling contact is latched in the coupling housing by a latch hook attached to the coupling housing and the latch hook is locked by the plug-in contact or the plug housing when the plug is connected to the coupling.

10. Unipolar high-current plug-in connector for a wind turbine generator system, comprising a plug-in contact in a plug housing and a coupling contact in a coupling housing, wherein the plug-in contact and the coupling contact have a cross-section of which the longitudinal extent exceeds the transverse extent, wherein the plug-in contact can be latched in the plug housing by a latch hook attached to the plug housing and the latch hook can be locked by the coupling contact or the coupling housing when the plug is connected to the coupling.

11. Unipolar high-current plug-in connector for a wind turbine generator system, comprising a plug-in contact in a plug housing and a coupling contact in a coupling housing, wherein the plug-in contact and the coupling contact have a cross-section of which the longitudinal extent exceeds the transverse extent, further comprising an externally visible coding.

12. Unipolar high-current plug-in connector according to claim 11, wherein the plug housing is provided with a profile groove for receiving one of a plurality of different plug coding elements, the coupling housing is provided with a profile groove, lying opposite the profile groove in the plug housing, for receiving one of a plurality of different coupling coding elements, each of the different plug coding elements cooperating with exactly one of the different coupling coding elements and thus enabling mechanical coding of the plug-in connection.

13. Unipolar high-current plug-in connector according to claim 12, wherein the plug coding elements comprise a web which extends parallel to the insertion direction and which engages in a corresponding groove in the associated coupling coding element, the web and the groove being arranged in different positions in each case for the different plug and coupling coding elements.

14. Unipolar high-current plug-in connector according to claim 12, wherein the coupling coding elements comprise a web which extends parallel to the insertion direction and which engages in a corresponding groove in the associated plug coding element, the web and the groove being arranged in different positions in each case for the different plug and coupling coding elements.

15. Unipolar high-current plug-in connector according to claim 12, wherein the different plug coding elements and the different coupling coding elements comprise a color coding corresponding to the mechanical coding.

16. Unipolar high-current plug-in connector according to claim 15, wherein the plug housing or the coupling housing comprises a viewing window which is arranged in the region of the profile groove and through which the colour coding of the plug or coupling coding element can be discerned.

17. Unipolar high-current plug-in connector for a wind turbine generator system, comprising a plug-in contact in a plug housing and a coupling contact in a coupling housing, wherein the plug-in contact and the coupling contact have a cross-section of which the longitudinal extent exceeds the transverse extent, wherein the coupling contact is latched in the coupling housing by a latch hook attached to the coupling housing and the latch hook is locked by the coupling coding element after the coupling coding element has been received in the profile groove.

18. Unipolar high-current plug-in connector for a wind turbine generator system, comprising a plug-in contact in a plug housing and a coupling contact in a coupling housing, wherein the plug-in contact and the coupling contact have a cross-section of which the longitudinal extent exceeds the transverse extent, wherein the plug-in contact is latched in the plug housing by a latch hook attached to the plug housing and the latch hook is locked by the plug coding element after the plug coding element has been received in the profile groove.

19. Unipolar high-current plug-in connector for a wind turbine generator system, comprising a plug-in contact in a plug housing and a coupling contact in a coupling housing, wherein the plug-in contact and the coupling contact have a cross-section of which the longitudinal extent exceeds the transverse extent, wherein the plug-in contact and the coupling contact have an oval cross-section.

20. Unipolar high-current plug-in connector according to claim 19, wherein the coupling contact is substantially in the form of a hollow cylinder and the plug-in contact is substantially in the form of a cylinder, it being possible to introduce the plug-in contact into the coupling contact in an insertion direction parallel to the cylinder axis of the plug-in contact and parallel to the cylinder axis of the coupling contact.

21. Unipolar high-current plug-in connector according to claim 19, wherein at least one annular spring element, which is arranged transverse to the insertion direction in the coupling contact and which can enclose the plug-in contact in the coupling contact and thus be held clamped.

22. Unipolar high-current plug-in connector according to claim 21, wherein the spring element is a flat coil spring wound in a torus shape.

23. Unipolar high-current plug-in connector according to claim 21, wherein projections for fixing the spring element are provided on the inside of the coupling contact.

24. Unipolar high-current plug-in connector according to claim 19, wherein the plug-in contact and the coupling contact are formed as a stamped and bent part.

25. Unipolar high-current plug-in connector according to claim 19, wherein the coupling contact is latched in the coupling housing by a latch hook attached to the coupling housing and the latch hook is locked by the plug-in contact or the plug housing when the plug is connected to the coupling.

* * * * *